US009988793B2

(12) United States Patent
Dauderman et al.

(10) Patent No.: US 9,988,793 B2
(45) Date of Patent: Jun. 5, 2018

(54) ACTUATOR ROD SCRAPER ASSEMBLY

(71) Applicant: DEERE & COMPANY, Moline, IL (US)

(72) Inventors: Bradley C. Dauderman, Dubuque, IA (US); Marvin D. Van Ee, Eldridge, IA (US); Zachary R. Sopher, Lynn Center, IL (US); Steven C. Gibbs, Independence, IA (US); Donald O. Johannsen, Potosi, WI (US)

(73) Assignee: DEERE & COMPANY, Moline, IL (US)

( * ) Notice: Subject to any disclaimer, the term of this patent is extended or adjusted under 35 U.S.C. 154(b) by 282 days.

(21) Appl. No.: 15/068,835

(22) Filed: Mar. 14, 2016

(65) Prior Publication Data

US 2017/0260716 A1 Sep. 14, 2017

(51) Int. Cl.

| | |
|---|---|
| ***E02F 9/22*** | (2006.01) |
| ***F15B 15/02*** | (2006.01) |
| *E02F 3/96* | (2006.01) |

(52) U.S. Cl.
CPC ..... *E02F 9/2271* (2013.01); *F15B 15/02* (2013.01); *E02F 3/964* (2013.01)

(58) Field of Classification Search
CPC .. F16J 15/324; F16J 9/206; F16J 9/203; F16J 5/56; E02F 9/2271; E02F 3/964; F15B 15/02; F15B 15/1461
See application file for complete search history.

(56) References Cited

U.S. PATENT DOCUMENTS

| | | | | |
|---|---|---|---|---|
| 1,828,178 A | | 10/1931 | Fox | |
| 2,634,145 A | * | 4/1953 | Monahan | F16J 15/3284 277/346 |
| 3,001,808 A | | 9/1961 | Frye | |
| 3,884,127 A | * | 5/1975 | Simmons | B64C 13/42 91/509 |
| 4,105,365 A | * | 8/1978 | Ferris | B64C 27/51 416/107 |

(Continued)

FOREIGN PATENT DOCUMENTS

WO 2015018537 A1 2/2015

OTHER PUBLICATIONS

Hydrowype Design and Engineering Guide, author unknown, p. 8, 2015.

*Primary Examiner* — Thomas E Lazo
(74) *Attorney, Agent, or Firm* — Taft Stettinius & Hollister LLP; Stephen F. Rost

(57) ABSTRACT

An actuator assembly having an end guide with a first end and a second end, the end guide defining an axis passing through the first and second end, a rod having an outer surface, the rod being movable along the axis through the end guide, a wiper disposed outwardly of the rod and within the end guide, a scraper disposed outwardly of the rod and within the end guide and spaced axially from the wiper towards the second end, a cavity defined between the wiper, the scraper, the outer surface of the rod, and the end guide, and an orifice defined in the end guide between the wiper and the scraper, the orifice defining a flow path for a lubricating fluid to flow into the cavity, wherein, the wiper and the scraper are disposed in contact with the outer surface of the rod for removing debris therefrom.

20 Claims, 6 Drawing Sheets

(56) References Cited

U.S. PATENT DOCUMENTS

| | | | | | |
|---|---|---|---|---|---|
| 4,211,151 | A * | 7/1980 | Wallischeck | B64C 13/40 | 34/360 |
| 4,300,439 | A * | 11/1981 | Degnan | B64C 13/40 | 89/36.02 |
| 4,449,446 | A * | 5/1984 | Degnan | B64C 13/36 | 89/36.02 |
| 5,007,276 | A * | 4/1991 | Kadis | B21D 24/02 | 267/119 |
| 5,165,700 | A | 11/1992 | Stoll et al. | | |
| 5,303,934 | A * | 4/1994 | Elliott | F16J 15/002 | 277/346 |
| 6,615,705 | B2 * | 9/2003 | Reinelt | E21D 15/15 | 91/169 |
| 6,681,682 | B2 * | 1/2004 | Niwa | F15B 15/1433 | 92/153 |
| 6,928,922 | B2 * | 8/2005 | Nagai | F04B 1/2014 | 277/438 |
| 7,000,744 | B2 * | 2/2006 | Harbu | F16F 9/3242 | 188/322.17 |
| 7,997,393 | B2 * | 8/2011 | Hart | F16F 9/3285 | 188/267.2 |

* cited by examiner

ACTUATOR ROD SCRAPER ASSEMBLY

FIELD OF THE DISCLOSURE

The present disclosure relates to a rod scraper for an actuator, and in particular, to at least one rod scraper positioned in an end guide and having fluid channels for receiving and exhausting fluids from a cavity.

BACKGROUND OF THE DISCLOSURE

Many work machines utilize a plurality of linear actuators to power various components of the work machine. In one example, the work machine is a backhoe and utilizes various actuators to control the position of a bucket. A user manipulates controls for the plurality of actuators and can selectively position the bucket. Frequently, the linear actuators have a rod that is positioned within a tube to move axially or telescopically relative to the tube in response to the inputs received from the controls. The actuators alter the linear distance between two mounting points to allow different components of the work machine to be repositionable relative to the work machine.

The actuators achieve different linear length between a rod end and a tube end by allowing portions of the rod to be encompassed by the tube. When the actuator is in a minimal linear length, a substantial portion of the rod may be encompassed by the tube. Alternatively, when the actuator is in a maximum linear length, a substantial portion of the rod may be outside of the tube and exposed to the surrounding elements. Accordingly, there are portions of the rod that may transition from a location outside of the tube to a location encompassed by the tube.

One type of linear actuator uses an end guide to move the rod along a linear axis between the maximum and minimum linear lengths. The end guide may provide a centralized through-hole that allows the rod to remain axially aligned with the tube as the rod transitions to any position between the minimum and maximum linear length. The end guide also often houses a wiper that is configured to wipe away any fine debris that forms on the rod when it is exposed to the surrounding elements.

Work machines are frequently used in environments that are prone to create varying levels and types of debris that may accumulate on the rod. If the work machine is used in a muddy setting, mud will accumulate and harden on the rod. Alternatively, if the work machine is utilized for agricultural development, dust or other fine particulate accumulates on the rod. Further still, if the work machine is used in a manufacturing setting, any type of debris such as molten plastic, adhesives, or any other material used during manufacturing can deposit on the rod.

SUMMARY

One embodiment may be an actuator assembly, comprising an end guide having a first end and a second end, the end guide defining an axis passing through the first and second end; a rod having an outer surface, the rod being movable along the axis through the end guide; a wiper disposed outwardly of the rod and within the end guide; a scraper disposed outwardly of the rod and within the end guide and spaced axially from the wiper towards the second end; a cavity defined between the wiper, the scraper, the outer surface of the rod, and the end guide; and an orifice defined in the end guide between the wiper and the scraper, the orifice defining a flow path for a lubricating fluid to flow into the cavity; wherein, the wiper and the scraper are disposed in contact with the outer surface of the rod for removing debris therefrom.

In one example, the end guide comprises at least a first internal diameter and a second internal diameter, the first internal diameter being less than the second internal diameter; wherein the wiper is disposed within the end guide at the first internal diameter and the scraper is disposed within the end guide at the second internal diameter. In another example, the scraper has limited axial movement when disposed in the end guide. Further, a seal may be positioned between the scraper and an inner diameter of the end guide.

In another example, the scraper comprises a radial discontinuity adapted to allow debris and lubricating fluid to exhaust from the cavity towards the second end. Further, a second scraper may be disposed within the end guide between the scraper and the wiper. In another example, each of the scraper and the second scraper have a radial discontinuity adapted to allow debris and lubricating fluid to exhaust from the cavity towards the second end.

Another embodiment may be an actuator assembly, comprising: an end guide having a first end and a second end, the end guide defining an axis passing through the first and second end; a rod having an outer surface, the rod being movable along the axis through the end guide; a wiper disposed outwardly of the rod and within the end guide; a first scraper disposed outwardly of the rod and within the end guide and spaced axially from the wiper towards the second end; a second scraper disposed outwardly of the rod and within the end guide and spaced axially between the wiper and the first scraper; a cavity defined between the wiper, the second scraper, the outer surface of the rod, and the end guide; and an orifice defined in the end guide between the wiper and the scraper, the orifice defining a flow path for a lubricating fluid to flow into the cavity; wherein, the wiper, the first scraper and the second scraper are disposed in contact with the outer surface of the rod for removing debris therefrom.

Yet another embodiment may be a system for scraping an actuator rod of a work machine, the system comprising: a chassis of the work machine; at least one ground engaging mechanism coupled to the chassis; an implement coupled to the chassis; an actuator coupled to the chassis and the implement, the actuator comprising: an end guide having a first end and a second end, the end guide defining an axis passing through the first and second end; a rod having an outer surface, the rod being movable along the axis through the end guide; a wiper disposed outwardly of the rod and within the end guide, the wiper composed substantially of a polymer; a first scraper disposed outwardly of the rod and within the end guide and spaced axially from the wiper towards the second end, the first scraper composed substantially of a steel; a cavity defined between the wiper, the first scraper, the outer surface of the rod, and the end guide; and an orifice defined in the end guide between the wiper and the scraper, the orifice defining a flow path for a lubricating fluid to flow into the cavity; wherein, the wiper and the scraper are disposed in contact with the outer surface of the rod for removing debris therefrom.

In one example, a second scraper is disposed outwardly of the rod and within the end guide and spaced axially between the wiper and the first scraper, the second scraper being composed of a predominantly brass, bronze, or aluminum material. Further, one example may have a first and second channel defined along a radially inner surface of the respective first and second scraper; wherein, the first and second channel define a fluid path between the first and second scraper and the outer surface of the rod; further wherein, fluid enters the cavity through the orifice and exits the cavity through the fluid path towards the second end.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
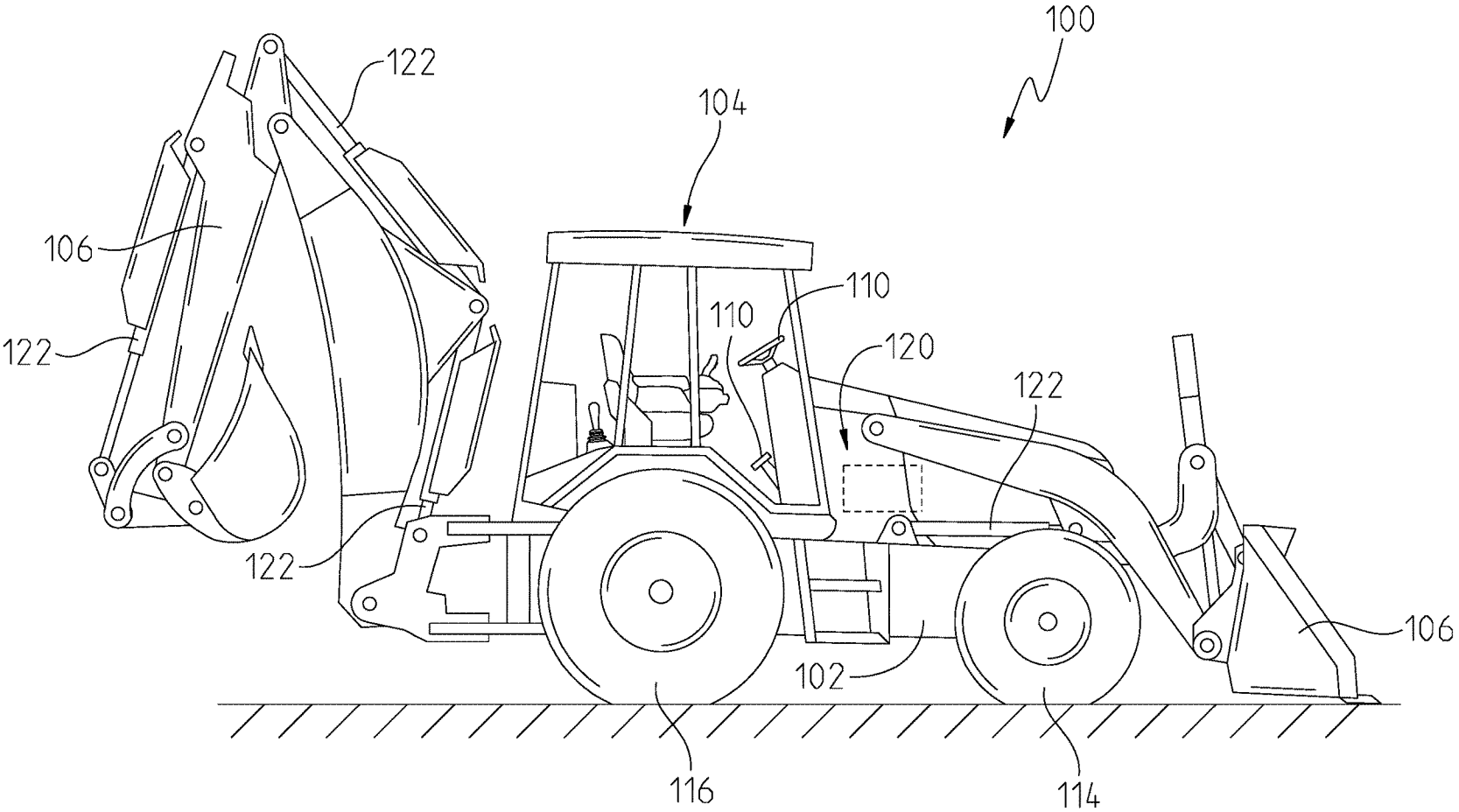
FIG. 1 is a side view of a work machine.

Referring to FIG. 1, a work machine 100 is shown. In one embodiment, the work machine 100 may be a backhoe. However, this disclosure is not limited to such a machine. Rather, the teachings of this disclosure are applicable to any work machine including, but not limited to, any work machine that utilizes at least one linear actuator 122. Further still, while many of the examples shown and described herein refer to mobile work machines, this disclosure equally applies to manufacturing machines that may be stationary and part of a manufacturing assembly line. Accordingly, this disclosure is not limited by any particular use of the actuator 122.

The work machine 100 in FIG. 1 has a chassis 102 coupled to a front set of wheels 114 and a rear set of wheels 116. Also coupled to the chassis 102 may be a cabin 104. The cabin 104 defines an interior region where a user may control the work machine 100 with a plurality of controls 110. While the front and rear set of wheels 114, 116 are shown and described; any form of ground engaging mechanism may be used. In one non-limiting example, tracks are used instead of wheels as a ground engaging mechanism. However, any known form of ground engaging mechanism is considered herein and no particular form of ground engaging mechanism is limiting.

In one aspect of the present disclosure, the plurality of controls 110 may be manipulated by the user to control the location of one or more implements 106 via the actuators 122. The plurality of controls 110 may be switches, levers, push buttons, a steering wheel, pedals, and any other similar control mechanism and this disclosure is not limited to any one type of control. This disclosure is equally applicable to any type of work machine. For example, any agricultural, construction, or forestry machine, as well as any manufacturing machine, may utilize the teachings of this disclosure. Further, any type of actuator will benefit from the teachings of this disclosure. More specifically, this disclosure applies at least to hydraulic actuators, electric actuators, pneumatic actuators, and any other similar actuators known to the person have skill in the relevant art.

Figure 2:
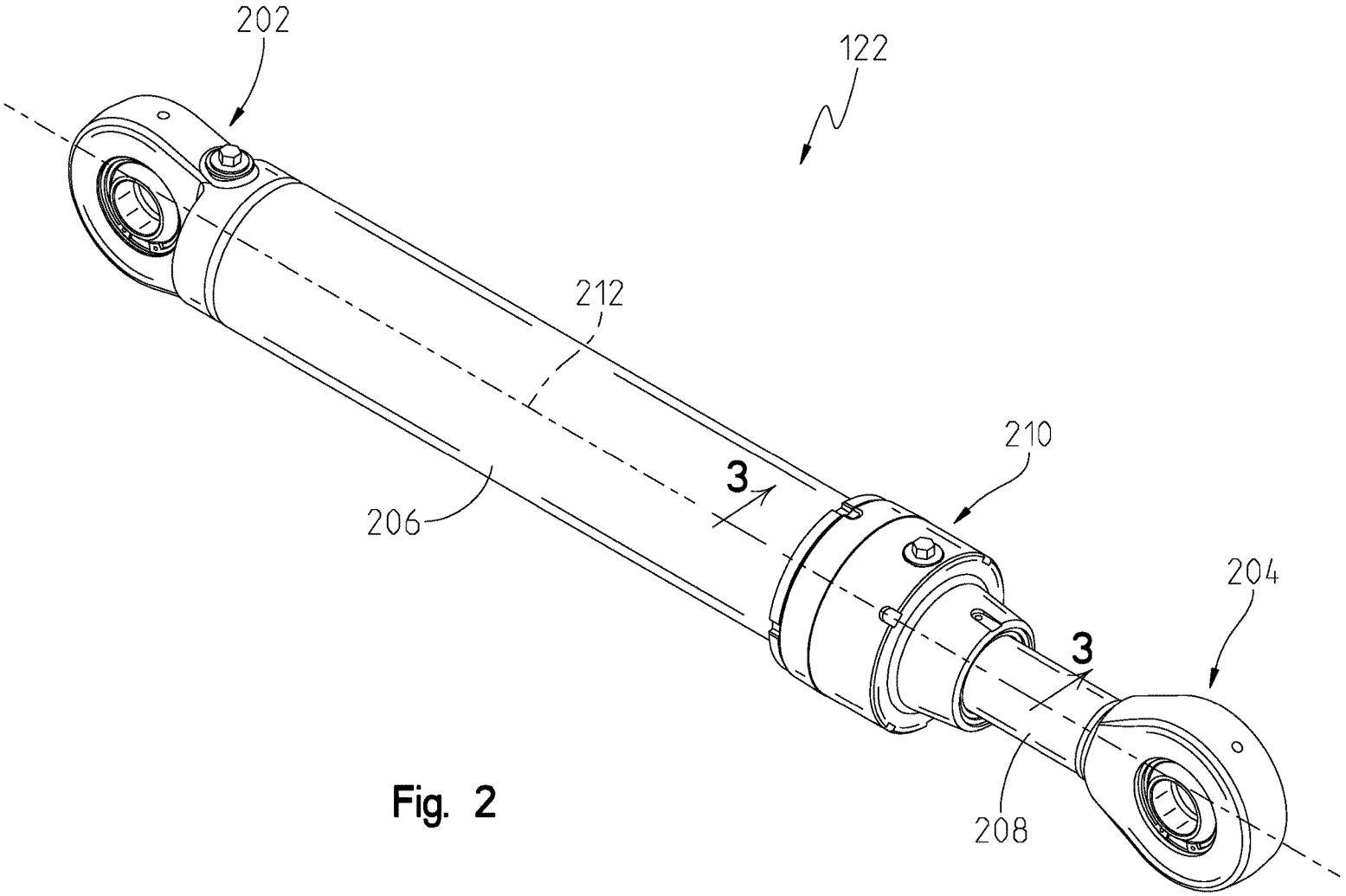
FIG. 2 is a perspective view of an actuator.

Referring now to FIG. 2, an isolated linear actuator 122 is shown. The actuator 122 may have a base end 202 and a rod end 204. An axis 212 may be defined through the base end 202 and the rod end 204. In one embodiment, the base end 202 may be fixedly coupled to a tube 206 or cylinder of the actuator 122. The actuator 122 may also have a rod 208 that is partially disposed within the tube 206 and disposed to telescopically move axially relative to the tube 206. The rod 208 may move out of the tube 206 through an end guide 210. The end guide 210 can be integrally formed with the tube 206 or removably fixed thereto. A person having skill in the relevant art understands that the end guide 210 may substantially maintain alignment of the rod 208 with the axis 212 as the rod moves axially relative to the tube 206.

Figure 3:
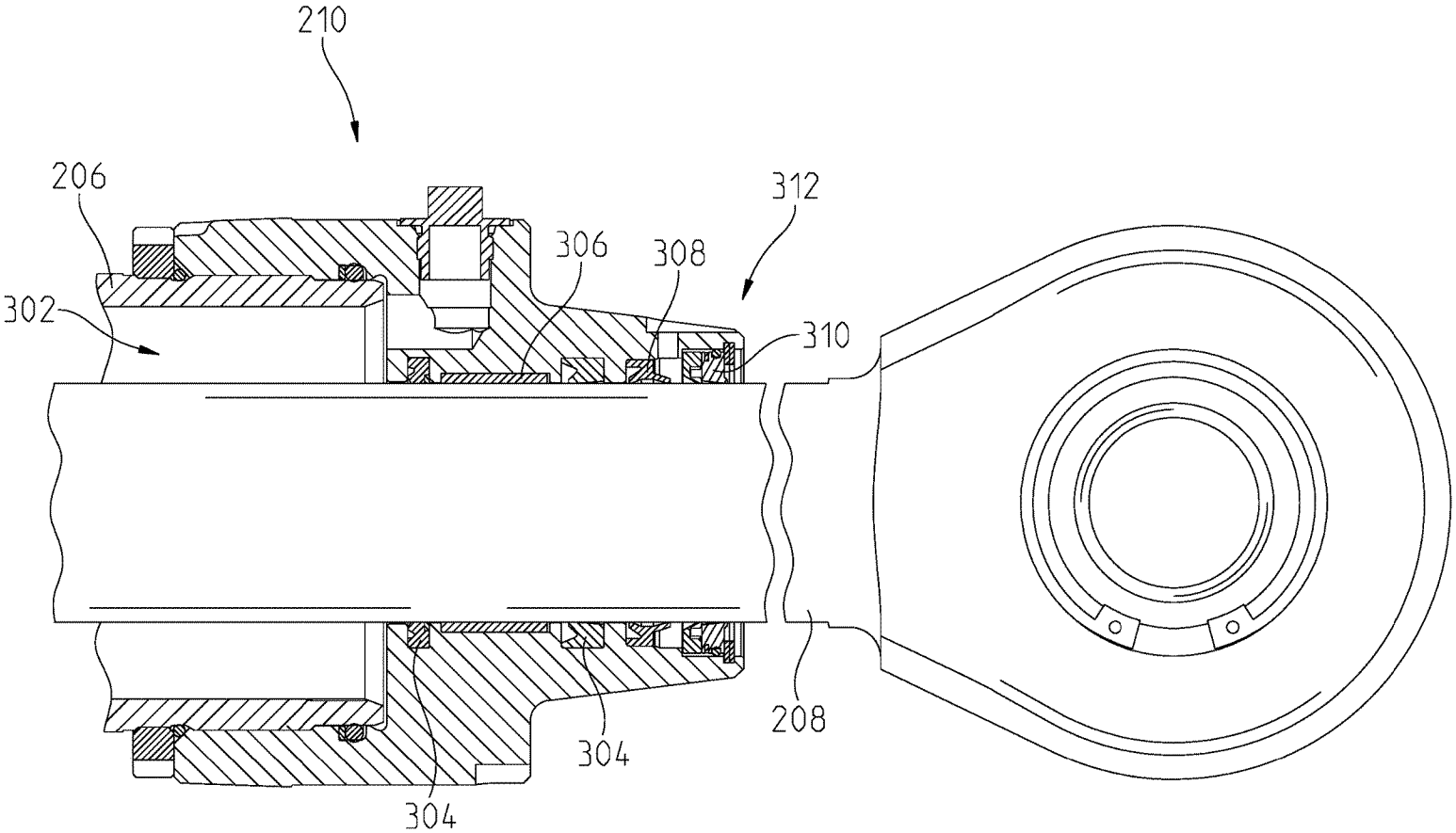
FIG. 3 is a partial cutaway view of the actuator of FIG. 2.

A partial cutaway view of the actuator 122 is shown in FIG. 3. More particularly, the rod 208 is shown extending from an inner chamber 302 of the tube 206 through the end guide 210. The end guide 210 may have one or more seals 304 positioned around the outer surface of the rod 208 and within radial cavities or seats defined along an internal surface of the end guide 210. In one embodiment, the seals 304 may fluidly seal the inner chamber 302 of the tube 206 while still allowing the rod 208 to move axially therethrough as is known to a person having skill in the art.

Also positioned radially adjacent to the rod 208 within the end guide 210 may be a wear ring 306. The wear ring 306 may also be positioned within a radial cavity or seat defined in the internal surface of the end guide 210. In one embodiment, the wear ring 306 is positioned to allow the rod 208 to slide thereon as the rod telescopically moves axially through the end guide 210. The wear ring 306 may be positioned to substantially maintain the axial alignment of the rod 208 relative to the tube 206. Further, the wear ring 306 may be made of a material that reduces friction between the wear ring 306 and the rod 208 to allow low-friction linear movement of the rod 208 through the end guide 210.

The end guide 210 may also define a groove or opening for at least one wiper 308 to be positioned radially about the rod 208. The wiper 308 may be positioned along an inner surface of the end guide 210 and coupled thereto. The inner portion of the wiper 308 may contact the outer surface of the rod 208. In one embodiment, as the rod 208 slides axially relative to the end guide 210, the outer surface of the rod 208 may slide along the inner surface of the wiper 308 which may wipe away any fine debris deposited on the rod 208. The wiper 308 may be formed from a polymer, such as urethane, that has advantageous elastic and frictional properties for wiping the surface of the rod 208 in one non-limiting example. In addition to urethane, the wiper 308 may be made of hydrogenated nitrile, nitrile, silicon, fluorocarbons, fluoroelastomers or any other similar material. This disclosure is not limited to the wiper 308 being made of the materials described above, however, and other materials such as metals or the like are also considered herein.

A first scraper 310 may be positioned at an axially distal portion 312 of the end guide 210 from the tube 206. The first scraper 310 may be positioned within a groove or recess in the end guide 210 and configured to at least partially contact the outer surface of the rod 208 as it moves axially relative to the end guide 210. In one non-exclusive embodiment, the first scraper 310 may substantially remove any coarse debris deposited on the rod 208. Further, the first scraper 310 may be positioned axially in the end guide 210 to be an initial contact point within the end guide 210 as the rod 208 slides from an extended position to a retracted position. That is to say, any coarse debris deposited on the rod 208 will first contact the first scraper 310 as the rod 208 slides from the extended position to the retracted position.

In one non-limiting example, the first scraper 310 may be made of a stainless steel, coated stainless steel, titanium or other similar non-corrosive metal. Alternatively, the first scraper 310 may be made of a softer metal (such as brass, copper, aluminum) or a polymer, plastic or the like to accommodate different work environments and the useful life of the overall system. In yet another embodiment, the first scraper 310 may have a surface coating along the inner surface that improves frictional properties between the first scraper 310 and the rod 208. In one nonexclusive example, a polytetrafluoroethylene (PTFE) may be used. However, the surface coating is not limited to any particular material and any coating with similar friction reducing properties as PTFE may be used. Further still, a spray on metallic coating may be used. In yet another embodiment, the scraper may have an inner surface with a copper alloy, steel alloy, brass alloy, bronze alloy, urethane, nitrile or the like coating thereon. Further still, the scraper may be entirely made of any one or more of these materials.

The rod 208 may have portions exposed to coarse debris that will adhere strongly to the exterior portion of the rod 208. In this non-limiting example, the first scraper 310 may be made of stainless steel to adequately scrape the strongly adhered coarse debris from the rod's surface. However, if the rod 208 will only be exposed to coarse debris that weakly adheres to the exterior portion of the rod 208, the first scraper 310 may be made of a softer material such as brass, copper, or a polymer, to sufficiently scrape the coarse debris from the surface of the rod 208. Any of the materials used for the wipers or scrapers described herein may vary as needed depending on how the actuator 122 will be used and the useful life of the overall system.

Figure 4:
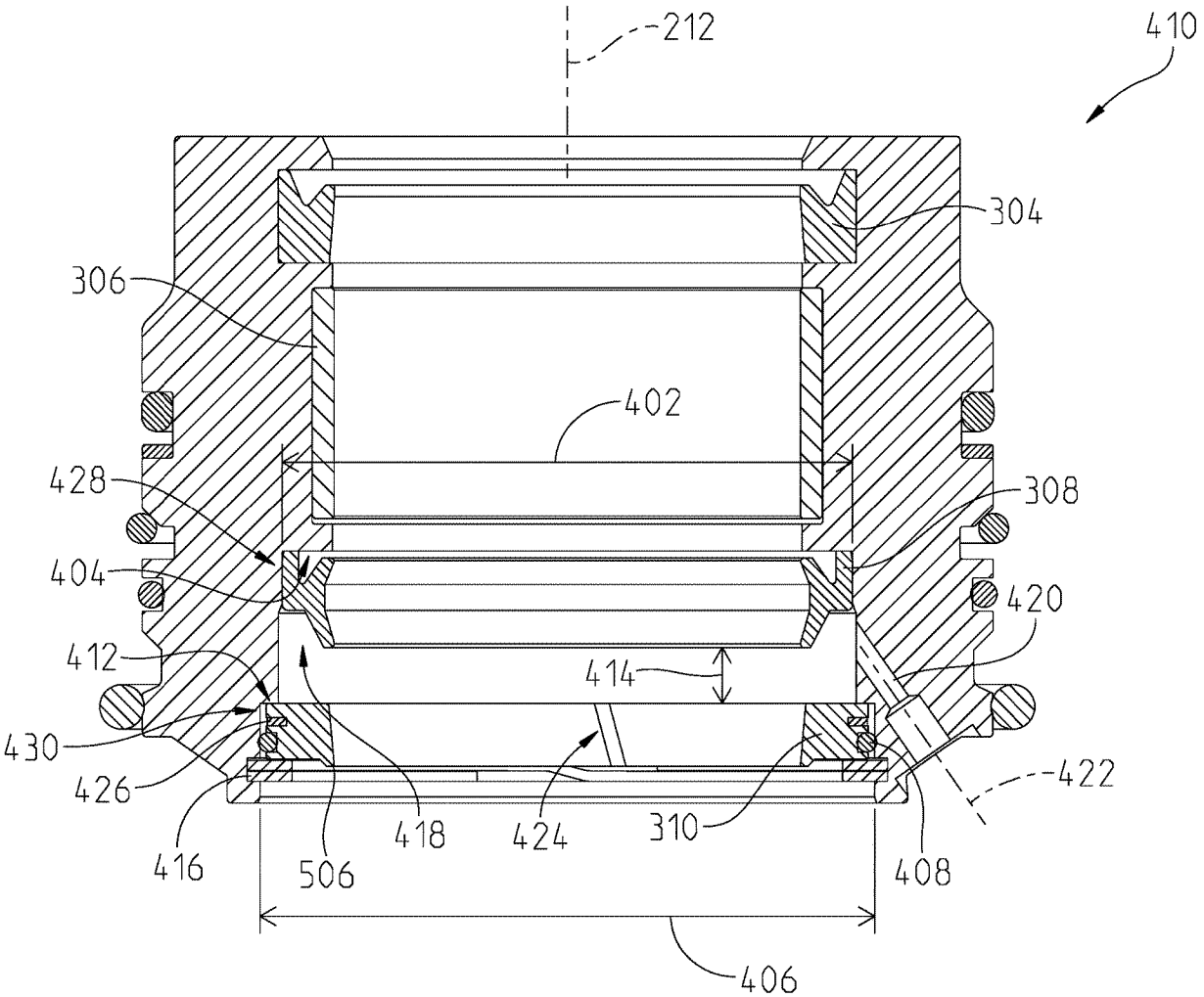
FIG. 4 is a cutaway view of a first embodiment of an end guide.

Referring now to FIG. 4, a cross-section view of one end guide 410 is shown. The end guide 410 may include a seal 304, a wear ring 306, a wiper 308, and the first scraper 310 as described above. The end guide 410 may also define a first receiver 428 having a first internal diameter 402 defined within the end guide 410. The wiper 308 may be positioned or otherwise coupled to the end guide 410 at the first receiver 428. More specifically, the wiper 308 may have an outer diameter or surface that corresponds with the first receiver 428 of the end guide 410 to allow the wiper 308 to be positioned therein. In one embodiment, the first receiver 428 may correspond with the outer diameter of the wiper 308 to allow the wiper 308 to be substantially press-fit therein. In yet another embodiment, the first receiver 428 may define a radial U-shaped pocket sized to couple to a portion of the wiper 308. Further, the radial U-shaped pocket may maintain the axial alignment of the wiper 308 when the wiper 308 is disposed partially therein.

The end guide 410 may also define a wiper lip 404 at a portion of the first receiver 428 that may contact the wiper 308 when the wiper 308 is in the proper axial alignment within the end guide 410. In this embodiment, the wiper 308 may be press into the first receiver 428 until it contacts the wiper lip 404, thereby restricting any further axial movement of the wiper 308 relative to the end guide 410.

While press-fit and U-shaped coupling configurations of the wiper 308 with the first receiver 428 have been described herein, other coupling methods are also considered. In one non-limiting example, a snap-ring or other similar coupling device can be used to ensure proper axial alignment of the wiper 308. In yet another embodiment, the first receiver 428 may be threaded and correspond with a threaded outer diameter of the wiper 308. In yet another embodiment, the wiper 308 may be coupled to the end guide 410 with an adhesive, welds, or the like. Accordingly, this disclosure is not limited to any particular way of coupling the wiper 308 to the end guide 410.

The end guide 410 may also define a second receiver 430 having a second internal diameter 406 that is sized larger than the first internal diameter 402. The second receiver 430 may be sized to correspond with the outer diameter of the first scraper 310. In one embodiment, the second internal diameter 406 of the end guide 410 may be slightly larger than the external diameter of the first scraper 310. In this embodiment, an O-ring 408 or other similar seal may be positioned radially between the second receiver 430 and the outer surface of the first scraper 310.

While the first and second receiver 428, 430, first scraper 310, wiper 308, rod 208, and other components have been shown and described as having diameters, this disclosure is not limited to components that have a circular cross-section. Rather, this disclosure could equally apply to an assembly wherein the above-described components have a cross-section that is square, rectangular, triangular, oval or any other similar geometry.

The O-ring 408 may substantially center the first scraper 310 about the axis 212 while allowing the first scraper 310 to move slightly within the end guide 410. By allowing minor movement of the first scraper 310 relative to the end guide 410, the first scraper 310 may more closely follow the profile of the outer surface of the rod 208 as it telescopically slides through the end guide 410. Additionally, the O-ring 408 may substantially seal the external portion of the first scraper 310 with the end guide 410. The sealing characteristics of the O-ring 408 may restrict debris from passing between the external portion of the first scraper 310 and the end guide 410. Further still, the O-ring 408 may provide an inward force on the first scraper 310 when stretched and placed around the first scraper 310.

A scraper lip 412 may also be defined in the end guide 410. The scraper lip 412 may be a stepped radial decrease in the end guide 410 that defines the axial position of the first scraper 310. During assembly, the first scraper 310 may be placed within the end guide 410 and slid axially until it contacts the scraper lip 412. Once the first scraper 310 is positioned within the end guide 410 and positioned in contact with the scraper lip 412, a lock or retaining ring 416 may be positioned within the end guide 410 to substantially restrict the first scraper 310 from moving axially away from the scraper lip 412.

The lock ring 416 may correspond with a groove defined in the inner surface of the end guide 410. In one embodiment, the lock ring 416 may be a spiral-type lock ring. The spiral-type lock ring 416 may not have any discontinuity along the radial face of the lock ring 416 and provide supplemental sealing properties along the outer portion of the first scraper 310. While a spiral-type lock ring 416 has been described above, this disclosure is not limited to any particular type of lock ring 416. Rather, any type of lock ring known in the art is also considered herein and this disclosure is not limited to any particular one.

Other coupling means are also considered herein for maintaining the axial alignment of the first scraper 310. Instead of a lock ring, the first scraper 310 may be threadably coupled to the end guide 410. Alternatively, the first scraper 310 may be press-fit into the end guide 410. In yet another embodiment, clips, adhesives, welds, or the like may be used to maintain the axial alignment of the first scraper 310.

The scraper lip 412 may be spaced axially from the wiper lip 404 to allow for a gap 414 between the first scraper 310 and the wiper 308 when they are each coupled to the end guide 410. When the rod 208 passes through the end guide 410, a corresponding cavity 418 is defined between the wiper 308, the first scraper 310, the outer surface of the rod 208, and the inner surface of the end guide 410. The cavity 418 may be substantially toroidal in shape and encompass a portion of the rod 208.

In one embodiment, an orifice or channel 420 may provide fluid coupling to the cavity 418 through a wall of the end guide 410. In this embodiment, the orifice or channel 420 may extend from an external portion of the end guide 410 and terminate at an internal portion of the end guide 410 axially positioned between the wiper lip 404 and the scraper lip 412. In the embodiment shown in FIG. 4, the orifice or channel 420 defines an orifice axis 422 that is angularly offset from the axis 212. In one example, the angular orientation of axis 422 relative to axis 212 is between 0° and 90°. In another example, the angular orientation is less than 90°. Further, a grease zerk or other similar fluid coupling device may be coupled externally to the orifice so that any fluid or lubricant can be injected into the cavity 418.

In one embodiment of the present disclosure, the first scraper 310 may have a radial discontinuity or gap 424 through a portion of the first scraper 310. The gap 424 may allow the first scraper 310 to expand and contract to exert a force against the rod 208. The gap 424 may allow the diameter of the first scraper 310 to increase to become positioned around the rod 208. Further, the gap 424 may allow the diameter of the first scraper 310 to decrease to allow proper contact with the outer surface of the rod 208. More specifically, the first scraper 310 may be designed to have an inner diameter smaller than the outer diameter of the rod 208 when the first scraper 310 is not positioned around the rod 208. However, to position the first scraper 310 around the rod 208, the first scraper 310 may be elastically deformed as the gap 424 expands to allow the first scraper 310 to become positioned around the rod 208. Accordingly, the first scraper 310 may have continuous force pressing the first scraper 310 against the surface of the rod 208 as a result of the elastic deformation of the first scraper 310.

Further, in another embodiment a spring 426 may be positioned about the outer edge of the first scraper 310 to exert a spring force against the first scraper 310. As described above, the gap 424 provides a location for the scraper to deflect responsive to the flex of the first scraper 310. Accordingly, the spring 426 may also apply pressure to the first scraper 310 to maintain contact with the outer surface of the rod 208.

Further, the gap 424 may decrease as the inner surface of the first scraper 310 wears down. More specifically, as the rod 208 telescopically slides against the first scraper 310, the inner surface of the first scraper 310 may wear. As the inner surface of the first scraper 310 wears, the size of the gap 424 will also decrease. In other words, as the first scraper 310 degrades along the radially inner surface, the gap in the gap 424 decreases in order to maintain contact between the first scraper 310 and the outer surface of the rod 208. Accordingly, the gap 424 provides a visual indication of the amount of wear experienced by the first scraper 310. In one example, a user can look into the end guide 410 and identify the size of the gap 424. If the gap 424 is substantially enclosed, it may be an indication that service is required.

The gap 424 may also define a fluid passage out of the cavity 418. As described above, the orifice 420 may allow fluid to be introduced into the cavity 418. To facilitate fluid flow through the cavity 418, the gap 424 of the first scraper 310 may allow any fluid in the cavity 418 to be exhausted therefrom.

In one non-exclusive example, grease or any other fluid may be injected into the cavity 418 through the orifice 420. The cavity 418 may become substantially filled with the grease and any debris disposed therein may be encapsulated in the grease. After the cavity 418 is substantially filled with grease, any additional pressure applied to the grease may force the grease through the gap 424 and out of the end guide 410. In this embodiment, grease can be pumped into the cavity 418 through the orifice 420 and exhausted through the gap 424 until substantially all of the debris within the cavity 418 has been removed. In addition to purging debris, the fluid selected may have properties that increase the effectiveness of the respective scrapers. In one non-exclusive example, the grease may reduce the adhesion of the soil or other debris to the rod 208.

While grease has been described as the fluid injected into the cavity 418 through the orifice 420, this disclosure considers any kind of fluid that may flush debris from the cavity 418 and/or lubricate the actuator 122. For example, instead of grease, any type of oil, water, air, or the like may be injected into the cavity 418 through the orifice 420 and this disclosure is not limited to any particular fluid.

Figure 5:
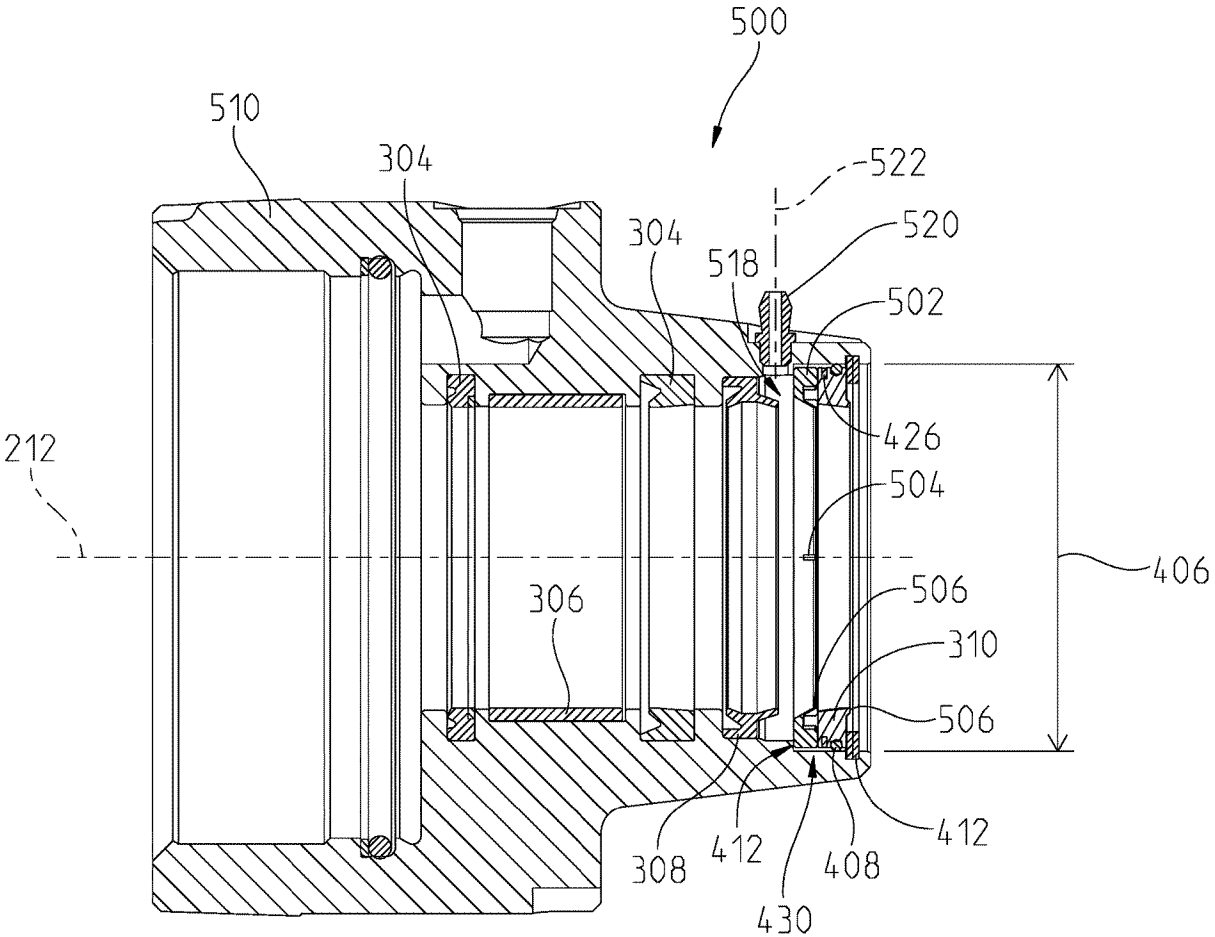
FIG. 5 is a cutaway view of a second embodiment of an end guide.

Referring now to FIG. 5, a two-scraper embodiment 500 of the present disclosure is shown. The two-scraper embodiment 500 may have an end guide 510 with a seal 304, wear ring 306, wiper 308, and first scraper 310 as described above for FIG. 4. In this embodiment, however, a second scraper 502 may be positioned axially between the first scraper 310 and the wiper 308. The second scraper 502 may also be positioned within the second receiver 430 but may be positioned axially between the first scraper 310 and the scraper lip 412. Accordingly, the scraper lip 412 may restrict the second scraper 502 from moving axially towards the wiper 308, and the first scraper 310 and lock ring 412 may restrict movement axially away from the wiper 308. That is to say, the second scraper 502 and the first scraper 310 are restricted from axial movement relative to the end guide 510 by the scraper lip 412 on one end and the lock ring 412 on the other.

In another embodiment, however, the second scraper 502 may be disposed within the end guide 510 at a third receiver having a third internal diameter (not shown) that is different from the first and second internal diameter 402, 406. In this embodiment, the third receiver may define a third lip axially spaced between the wiper lip 404 and the scraper lip 412. The wiper 308 may be sized to be slide past the third lip to be seated along the wiper lip 404, the second scraper 502 may be sized to slide past the scraper lip 412 to be seated at the third lip, and the first scraper 310 may be sized to be seated at the scraper lip 412. Accordingly, the axial position of each of the wiper 308, the second scraper 502, and the first scraper 310 along the end guide 510 may be restricted by the axial location of the respective wiper lip 404, third lip, and scraper lip 412.

In yet another embodiment, the first and second receivers 428, 430 may have the same diameter as the third internal diameter. In this embodiment, lock rings similar to the lock ring 412 can be positioned within the respective end guide 410, 510 to provide proper axial spacing of the wiper 308, and any scrapers 310, 502 positioned therein. More specifically, instead of utilizing the wiper lip 404 and the scraper lip 412 to axially space the components, the lock rings can be positioned axially on both sides of the wiper 308 and/or scrapers 310, 502 to axially position the components within the end guide 410, 510.

The end guide 510 may also define a cavity 518 therein. The cavity 518 may be substantially the same as the cavity 418 shown in FIG. 4 except that the second scraper 502 defines a boundary of the cavity 518 instead of the first scraper 310. The end guide 510 may also have an orifice or channel 520 that define a fluid passage into the cavity 518 similar to the embodiment shown in FIG. 4. However, in the embodiment of FIG. 5, the orifice 520 may define an orifice axis 522 that is perpendicular to the axis 212.

The second scraper 502 may also have one or more fluid channels 504 defined along a radially inner portion. The fluid channels 504 may provide a fluid path for fluid disposed within the cavity 518 to be exhausted out of the cavity 518 similar to the gap 424 in the first scraper 310. More specifically, fluid introduced into the cavity 518 through the orifice 520 can travel through the fluid channels 504 of the second scraper 502 before being exhausted through the gap 424 of the first scraper 310 as described above.

Additionally, the second scraper 502 may have an outer diameter that is slightly less than the second internal diameter 406. The slightly smaller outer diameter of the second scraper 502 may allow fluid to pass between the second scrapers 502 outer portion or surface and the end guide 510.

The second scraper 502 may define fluid passageways both through the fluid channels 504 and around the outer diameter. After fluid from the cavity 518 passes the second scraper 502, it may be exhausted from the end guide 510 through the gap 424 or along the surface of the rod 208. Further still, the second scraper 502 may be sized to have an outer diameter smaller than the diameter of the second receiver 430 to allow the second scraper 502 to become slightly offset from the axis 212. The slight movement of the second scraper 502 may allow the second scraper 502 to maintain contact with the surface of the rod 208 if the rod 208 becomes offset from the axis 212.

In one non-exclusive embodiment, the second scraper 502 may be made of a different material than the first scraper 310. More specifically, the first scraper 310 may be made of any of the materials described above and configured to remove coarse debris adhered to the outer surface of the rod 208. The second scraper 502 may also be made primarily from any of the materials described above. In one non-exclusive example, the first scraper 310 may primarily be made of stainless steel while the second scraper 502 may primarily be made of brass, aluminum, or any other similar material and may be configured to remove debris missed by the first scraper 310. Further, either of the first or second scraper 310, 502 may have a material coating on the radially inner surface, such as PTFE, as described above. In one embodiment, the material coating on the scrapers 310, 502 may reduce the friction generated between the scrapers 310, 502 and the rod 208, thereby improving wear life of the scrapers 310, 502 and the rod 205. In yet another embodiment the material coating may also be made from a material that will condition or lubricate the outer surface of the rod 208 to slide more easily through the end guide.

In one non-exclusive example, defects such as scratches may form on the surface of the rod 208. The first or second scraper 310, 502 may be composed of a material that can be deposited into the defects or scratches on the outer surface of the rod 208 to provide an outer surface that is substantially smooth. By conditioning the rod 208, the number of maintenance or service intervals for the seals 304, wear ring 306, and wiper 308 may be reduced because the defects in the rod 208 are substantially addressed as the rod 208 moves between the maximum position and the minimum position.

Figure 6:
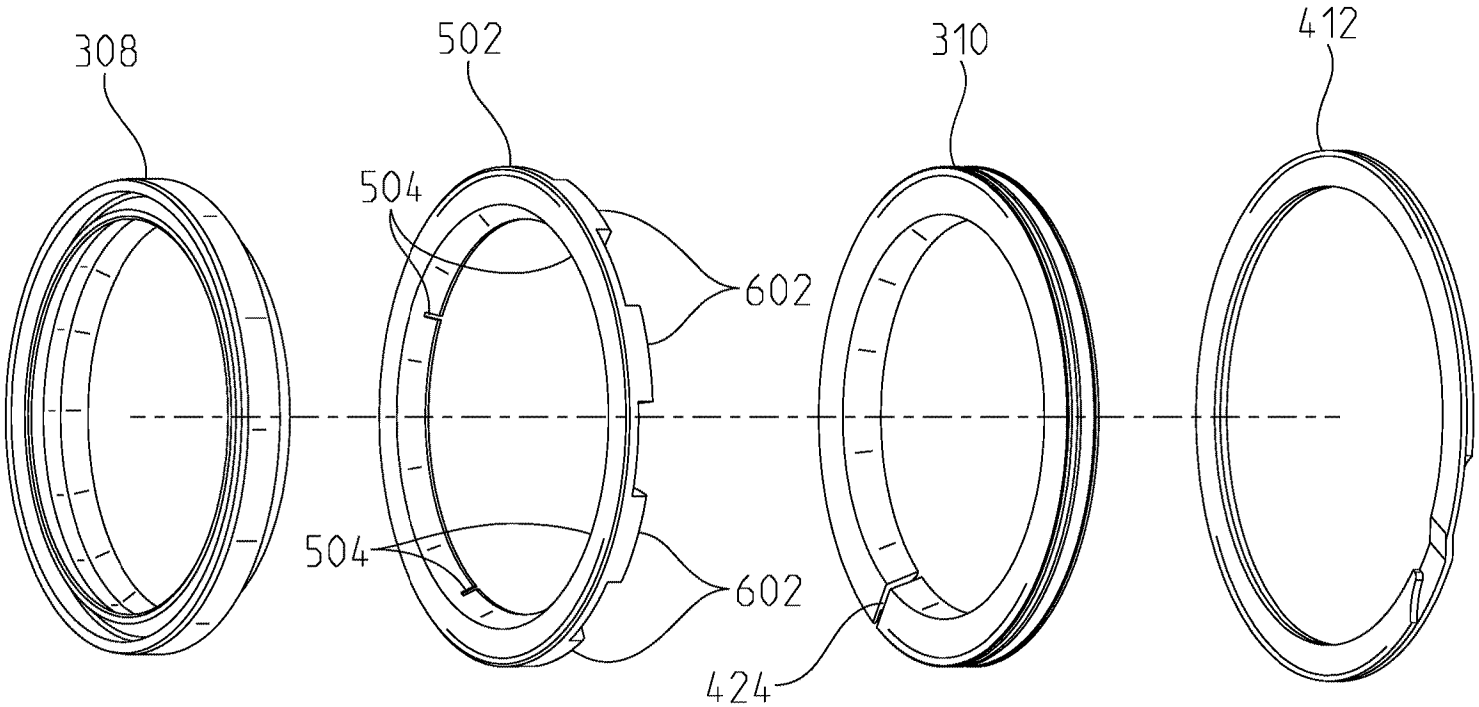
FIG. 6 is an exploded view of select internal components of the end guide from FIG. 5.

Now referring to FIG. 6, some of the internal components of the end guide 510 are shown in exploded form with the end guide 510 removed. More specifically shown in FIG. 6 is the radial spacing of the fluid channels 504 defined in the second scraper 502 and the gap 424 formed in the first scraper 310. Also shown in FIG. 6 is a plurality of spacers 602 positioned radially about the second scraper 502. The spacers 602 may be sized to position the second scraper 502 axially adjacent to the first scraper 310 without interfering with a radially inner scraping edge of the first and second scraper 310, 502. In other words, a leading edge of the second scraper 502 will not substantially contact a trailing edge of the first scraper 310 because the spacers 602 axially space them from one another. The radial spacing of the plurality of spacers 602 may also define a gap between adjacent spacers 602. The gap may further allow fluid to flow around the radially outer edge of the second scraper 502 and towards the gap 424 as described in more detail above.

In one embodiment, the gap 424 may be positioned at only one radial location in the first scraper 310 to define a first gap pattern. As described above, the gap 424 may be a gap defined through the entire section of the first scraper 310. Further, the gap 424 may allow the first scraper 310 to maintain a radially inward pressure on the rod 208 while also defining a fluid path from the cavity 418. Similarly, there may be four fluid channels 504 radially spaced and defined in the second scraper 502 according to a second gap pattern. The fluid channels 504 may be defined partially into the inner surface of the second scraper 502. However, the fluid channels 504 may be sufficiently sized to allow fluid from the cavity 418 to flow therethrough.

In one nonexclusive example, fluid may be pumped into the cavity 418 through the orifice 520. The fluid may accumulate between the wiper 308, the second scraper 502, the outer surface of the rod 208, and the end guide 510 until the cavity 418 is substantially filled with fluid. When additional pressure is applied to the fluid in the cavity 418, the fluid may be forced through the fluid channels 504 of the second scraper 502. After passing through the fluid channels 504 of the second scraper 502, the fluid may flow through the gap 424 of the first scraper 310 and be exhausted out of the end guide 510 along the outer surface of the rod 208.

While separate gap patterns have been described above, any gap pattern may be used that allows fluid flow therethrough. More specifically, the first and second scraper 310, 502 may each have the same gap pattern instead of different gap patterns. In one embodiment, the first scraper 310 may have fluid channels like the second scraper 502 instead of the gap 424. In yet another embodiment, the second scraper 502 may have a gap instead of the fluid channels 504 described above. This disclosure is not limited to any particular number or type of gap pattern on a scraper.

Further still, in another non-limiting embodiment, the first or second scrapers 310, 502 may have a leading edge 506 that is defined as a tapered cross-section along the inner portion of the respective scraper 310, 502 (see FIG. 5). The leading edge 506 may be defined at an axial location within the respective scraper 310, 502 that is furthermost from the wiper 308. In this embodiment, the tapered cross-section may allow fluid disposed in the cavity 418, 518 to become partially compressed against the outer surface of the rod 208 as the rod 208 transitions axially towards the maximum position. The compression of the fluid may allow some of the fluid to pass between the outer surface of the rod 208 and the respective scraper 310, 502 in a hydroplane fashion. Accordingly, in addition to the flow paths described above, some fluid may also be exhausted along the outer surface of the rod 208 as the rod 208 moves axially towards its maximum position.

Alternatively, the tapered leading edge 506 may substantially restrict any debris or fluid from escaping past the respective scraper 310, 502 as the rod 208 moves towards its minimum position. As the rod 208 moves towards the minimum position, the leading edge 506 will slide along the outer surface of the rod 208 with the leading edge 506 substantially removing any fluid or debris disposed on the surface of the rod 208. Accordingly, the leading edge 506 will sheer a substantial portion of any debris or fluid disposed on the outer surface of the rod 208 away from the rod 208 as it moves towards its minimum position.

In one embodiment of the present disclosure, a method for manufacturing the end guide may utilize the dimensions of an existing end guide and axially reposition the internal components to implement the teachings of this disclosure. More specifically, seats or grooves defined in the end guide for the seals 304 and wear ring 306 may be positioned axially adjacent to one another within the end guide and biased towards the portion of the end guide closest to the tube 206.

The first receiver 428 may be a first partial through-hole bored into the end guide at the axially distal end along the axis 212. The first partial through-hole may have a diameter consistent with the first internal diameter 402 and travel axially into the first end to terminate at the wiper lip 404. Similarly, the second receiver 430 may be a second partial through-hole bored into the end guide at the axially distal end along the axis 212. The second partial through-hole may have a diameter consistent with the second internal diameter 406 and travel axially into the first end to terminate at the scraper lip 412.

The orifice 420, 520 may then be formed by drilling a hole through a portion of the end guide 410, 510 that extends radially inward from an external surface and terminates at an internal surface located axially between the scraper 310, 502 and the wiper 308. A grease zerk or other similar fitting may be coupled to the end guide 410, 510 at the external surface of the end guide 410, 510 adjacent to the orifice 420, 520.

The seals 304 and wear ring 306 may then be positioned within the end guide at their respective seats. The wiper 308 may be pressed into the first receiver 428 until it contacts the wiper lip 404. Then the first scraper 310 or the first and second scraper 310, 502 may be pressed or otherwise positioned into the end guide 410, 510 at the second receiver 430 until the respective scraper 310, 502 contacts the scraper lip 412. Finally, the lock ring 416 may be positioned within the end guide proximate to the axially distal end to substantially lock the axial location of the respective scrapers 310, 502 relative to the end guide 410, 510.

Next, the rod 208 may be positioned through the end guide and the end guide may be coupled to the tube 206. Finally, fluid, such as grease, may be injected into the cavity 418 through the orifice 420 via the grease zerk and the actuator 122 may be mounted to the work machine 100.

In another non-exclusive embodiment, the scrapers 310, 502 and the wiper 308 and the corresponding components and features described above may not be defined and positioned directly within the end guide 410, 510. Rather, in this embodiment a separate housing may be coupled to the end guide 410, 510 axially adjacent to the end guide along the axis 212. In this embodiment, the housing may be coupled to the end guide 410, 510 using any technique known in the art such as corresponding threads, welds, brackets, or any other similar coupling mechanism. Further, the housing and corresponding scrapers 310, 502 and wipers may function in substantially the same way as described above.

In yet another aspect of the embodiment with a housing, the wiper 308 may be defined in the end guide 410, 510 and only the first or second scraper 310, 502 may be defined in the housing. In this embodiment, the housing may define the cavity 418 at a location axially between the first or second scraper 310, 502 and the end guide 410, 510. Accordingly, the housing may be coupled to the end guide 410, 510 to provide the features and components described above.

Although the illustrated embodiments in this application only show an actuator having a single rod, it is to be understood that the teachings of this disclosure may apply to an actuator having one or more rods such as a multi-stage or telescopic cylinder. Thus, the number of rods is not limiting to the teachings of this disclosure.

While embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. An actuator assembly, comprising:

an end guide having a first end and a second end, the end guide defining an axis passing through the first and second ends;

a rod having an outer surface, the rod being movable along the axis through the end guide between a retracted position and an extended position;

a wiper disposed within the end guide;

a scraper disposed within the end guide and spaced axially from the wiper towards the second end;

a gap defined in the scraper;

a cavity defined between the wiper, the scraper, the outer surface of the rod, and the end guide; and an orifice defined in the end guide between the wiper and the scraper, the orifice defining a flow path for a lubricating fluid to be injected into the cavity;

wherein, the wiper and the scraper are disposed in contact with the outer surface of the rod for removing debris therefrom as the rod moves between the extended position and the retracted position;

further wherein, the gap directs debris and lubricating fluid to exhaust from the cavity towards the second end.

2. The actuator assembly of claim 1, wherein the end guide comprises at least a first receiver having a first internal diameter and a second receiver having a second internal diameter, the first internal diameter being less than the second internal diameter;

wherein the wiper is disposed within the end guide at the first receiver and the scraper is disposed within the end guide at the second receiver.

3. The actuator assembly of claim 2, wherein a lock ring retains the scraper in the second receiver.

4. The actuator assembly of claim 1, further comprising a seal positioned between the scraper and an inner diameter of the end guide.

5. The actuator assembly of claim 1, further comprising a lock ring disposed axially adjacent to the scraper at the second end of the end guide, the lock ring coupled to the end guide and adapted to substantially restrict the scraper from moving axially towards the second end.

6. The actuator assembly of claim 1, wherein a grease zerk is coupled to the end guide at the orifice.

7. The actuator assembly of claim 1, wherein the end guide comprises a housing removably coupled thereto, the scraper positioned within the housing.

8. The actuator assembly of claim 1, wherein a second scraper is disposed within the end guide between the scraper and the wiper.

9. The actuator assembly of claim 8, wherein the end guide has a third receiver having a third internal diameter and the second scraper is disposed within the end guide at the third receiver.

10. The actuator assembly of claim 9, wherein each of the scraper and the second scraper have a gap adapted to allow debris and lubricating fluid to exhaust from the cavity towards the second end.

11. The actuator assembly of claim 1, wherein the orifice is defined within the end guide at an angle less than 90 degrees relative to the axis.

12. An actuator assembly, comprising:

an end guide having a first end and a second end, the end guide defining an axis passing through the first and second end;

a rod having an outer surface, the rod being movable along the axis through the end guide;

a wiper disposed outwardly of the rod and within the end guide;

a first scraper disposed outwardly of the rod and within the end guide and spaced axially from the wiper towards the second end;

a second scraper disposed outwardly of the rod and within the end guide and spaced axially between the wiper and the first scraper;

a cavity defined between the wiper, the second scraper, the outer surface of the rod, and the end guide; and an orifice defined in the end guide between the wiper and the scraper, the orifice defining a flow path for a lubricating fluid to be injected into the cavity;

wherein, the wiper, the first scraper and the second scraper are disposed in contact with the outer surface of the rod for removing debris therefrom.

13. The actuator assembly of claim 12, further wherein a surface along the inner diameter of at least one of the first or second scrapers has a material coating for conditioning the outer surface of the rod.

14. The actuator assembly of claim 12, further comprising a seal positioned between the first scraper and an inner diameter of the end guide, the seal substantially restricting lubricating fluid or debris from being transferred between the first scraper and the inner diameter of the end guide.

15. The actuator assembly of claim 12, wherein:

the first scraper comprises at least one of stainless steel or titanium;

the second scraper comprises at least one of copper, copper alloy, brass, brass alloy, bronze, or a bronze alloy; and the wiper comprises at least one of urethane, hydrogenated nitrile, nitrile, silicon, fluorocarbon, or a fluoroelastomer.

16. The actuator assembly of claim 12, further comprising a lock ring coupled to the end guide, the lock ring restricting axial movement of both the first and second scraper towards the second end.

17. The actuator assembly of claim 12, wherein the first scraper has a first gap pattern defined along a first inner surface and the second scraper has a second gap pattern defined radially along a second inner surface, the first gap pattern being different from the second gap pattern.

18. A system for scraping an actuator rod of a work machine, the system comprising:

a chassis of the work machine;

at least one ground engaging mechanism coupled to the chassis;

an implement coupled to the chassis;

an actuator coupled to the chassis and the implement, the actuator comprising:

an end guide having a first end and a second end, the end guide defining an axis passing through the first and second end;

a rod having an outer surface, the rod being movable along the axis through the end guide;

a wiper disposed outwardly of the rod and within the end guide, the wiper composed substantially of a urethane;

a first scraper disposed outwardly of the rod and within the end guide and spaced axially from the wiper towards the second end, the first scraper composed substantially of a steel;

a cavity defined between the wiper, the first scraper, the outer surface of the rod, and the end guide; and an orifice defined in the end guide between the wiper and the scraper, the orifice defining a flow path for a lubricating fluid to flow into the cavity;

wherein, the wiper and the scraper are disposed in contact with the outer surface of the rod for removing debris therefrom.

19. The system of claim 18, further comprising a second scraper disposed outwardly of the rod and within the end guide and spaced axially between the wiper and the first scraper, the second scraper being composed of a predominantly brass, bronze, or aluminum material.

20. The system of claim 19, further comprising:

a first and second channel defined along a radially inner surface of the respective first and second scraper;

wherein, the first and second channel define a fluid path between the first and second scraper and the outer surface of the rod;

further wherein, fluid enters the cavity through the orifice and exits the cavity through the fluid path towards the second end.

* * * * *